US006486755B2

(12) United States Patent
Aruga

(10) Patent No.: US 6,486,755 B2
(45) Date of Patent: Nov. 26, 2002

(54) VERTICAL TRANSITION DEVICE FOR DIFFERENTIAL STRIPLINE PATHS AND OPTICAL MODULE

(75) Inventor: Hiroshi Aruga, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/881,813

(22) Filed: Jun. 18, 2001

(65) Prior Publication Data

US 2002/0070826 A1 Jun. 13, 2002

(30) Foreign Application Priority Data

Oct. 31, 2000 (JP) ..... 2000-332593

(51) Int. Cl.[7] ..... H01P 3/08
(52) U.S. Cl. ..... 333/246; 333/260; 333/4
(58) Field of Search ..... 333/246, 247, 333/249, 254, 260

(56) References Cited

U.S. PATENT DOCUMENTS 3,792,383 A * 2/1974 Knappenberger ..... 29/600
4,626,889 A * 12/1986 Yamamoto et al. ..... 257/664
6,388,208 B1 * 5/2002 Kiani et al. ..... 174/260

FOREIGN PATENT DOCUMENTS

JP 4-802 1/1992
JP 2000-68716 3/2000

* cited by examiner

*Primary Examiner*—Michael Tokar
*Assistant Examiner*—Don Phu Le
(74) *Attorney, Agent, or Firm*—Burns, Doane, Swecker & Mathis, LLP

(57) ABSTRACT

A vertical transition device for differential stripline paths, connects differential microstrip paths on a horizontal plane with differential triplate paths on another horizontal plane in a multilayered architecture. The differential microstrip paths include a pair of differential microstrip lines. The differential triplate paths include a pair of triplate lines. The differential microstrip lines are connected with the differential triplate lines by via-holes within the transition device, respectively.

10 Claims, 8 Drawing Sheets

VERTICAL TRANSITION DEVICE FOR DIFFERENTIAL STRIPLINE PATHS AND OPTICAL MODULE

BACKGROUND OF THE INVENTION

1. Field of the Invention

The present invention relates to a vertical transition device for differential stripline paths and more particularly to a vertical transition device for connecting paths on a horizontal plane with paths on another horizontal plane. The present invention also relates to an optical module incorporating the vertical transition device.

2. Prior Art

Optical modules, which are devices used for transmitting and receiving optical signals through optical fibers, are needed to enhance transmission speed of data while it should be downsized. On account of such demands, developed was a type of optical module incorporating an electrical/optical converting element such as a semiconductor laser diode, an amplifier for actuating the E/O converting element, an MUX (multiplexer), a DEMUX (demultiplexer), and other suitable elements integrally.

It is necessary to exchange various sorts of signals including lower frequency signals and radio frequency signals between the structural elements of the module. Therefore, in order to minimize influences of exterior noises and inequality of power supply voltage, this type of optical module is usually provided with a pair of differential paths for propagating differential signals.

A package architecture of the module may comprise a multilayered path arrangement including a plurality of dielectric materials, such as ceramic substrates, arranged in layer, and signal paths and power supply paths formed on or between the dielectric materials. To assemble such a package architecture of an optical module with a high packing density from such multilayered path structures, it is preferable to utilize a vertical transition device wherein differential microstrip lines and differential triplate lines on both sides of a dielectric layer are interconnected by vertical via-holes.

FIGS. 9 through 11D show a conventional vertical transition device for a stripline path. FIG. 9 is a see-through perspective view showing the vertical transition device. FIG. 10 is a vertical cross sectional view taken along line X–X' in FIG. 9. FIG. 11A is a top view of the vertical transition device. FIG. 11B is a horizontal sectional diagram of the vertical transition device taken along plane A in FIG. 9. FIG. 11C is a horizontal sectional diagram of the vertical transition device taken along plane B in FIG. 9. FIG. 11D is a horizontal sectional diagram of the vertical transition device taken along plane C in FIG. 9.

As shown in the drawings, the vertical transition device comprises dielectric layers 1, 2, and 3, a microstrip line 4, a triplate line 5, a signal via-hole 6, ground planes 7 and 8, and three matching via-holes 9. The matching via-holes 9, which connect the ground plane 7 with the ground plane 8, are arranged in the vicinity of the signal via-hole 6 and equally apart from the signal via-hole 6, so as to form a coaxial path structure. The signal via-hole 6 is connected at both ends with the microstrip line 4 and the triplate line 5.

Adjusting the distance between the signal via-hole 6 and the matching via-holes 9 results in a change of the impedance of the coaxial path structure. It means that it is possible to match the impedance of the coaxial path structure with the characteristic impedance of the microstrip line 4 and the triplate line 5 by a prior experiment or a simulation. Thus, a suitable vertical transition device in which impedance matching is accomplished for a stripline path can be manufactured.

In an application of the above-described vertical transition device to an optical module having a pair of differential paths, two vertical transition devices are interposed in the differential paths, respectively. In other words, a conventional vertical transition device for differential stripline paths comprises a pair of this type of vertical transition devices.

With such a structure, the conventional vertical transition device for a stripline path involves problems that will be described next.

FIG. 12 is a conceptual diagram showing a cross section of differential microstrip paths taken along a plane perpendicular to the signal propagation direction, and showing lines of electric forces. Sign S indicates the distance between the microstrip lines constituting the microstrip paths while sign W indicates the width of each microstrip line. Differential microstrip paths has a propagation mode wherein an electric field between the adjacent microstrip lines and electric fields between the ground plane and the microstrip lines are coupled with each other. It is a merit of the differential microstrip paths to lessen the influence of exterior noises or disturbances upon the subject electric signals. In order to bring out the merit, it is preferable that the distance S is narrow for concentrating the field intensity at the region between the microstrip lines.

However, although the above-described conventional aggregation of two stripline vertical transition devices is utilized in differential paths, the distance between microstrip lines is too long to couple electric fields together. This seriously impairs the merit of the differential paths. In addition, such an aggregation is complicated and large too much, and the provision of a plurality of matching via-holes 9 leads a further enlargement and a further complication of the resultant vertical transition device.

SUMMARY OF THE INVENTION

Accordingly, it is an object of the present invention to provide a vertical transition device accommodated to differential stripline paths, having a simpler construction without use of matching via-holes.

It is another object of the present invention to provide an optical module incorporating the vertical transition device.

In accordance with an aspect of the present invention, there is provided a vertical transition device for differential stripline paths, comprising differential microstrip paths and differential triplate paths. The differential microstrip paths include a first dielectric layer, a second dielectric layer, a first ground plane interposed between the first and second dielectric layers, and first and second microstrip lines disposed on a surface of the first dielectric layer opposing to the first ground plane, the microstrip lines and the first dielectric layer causing an electric field coupling for propagating differential signals. The differential triplate paths include a third dielectric layer, a second ground plane disposed on a surface of the third dielectric layer, and first and second triplate lines disposed between the second and third dielectric layers, the triplate lines and the first and second dielectric layers causing an electric field coupling for propagating the differential signals. The vertical transition device further comprises a first via-hole for connecting an end of the first microstrip line with an end of the first triplate line, a second via-hole for connecting an end of the second microstrip line with an end of the second triplate line, and an aperture formed in the first ground plane, the first and second via-holes are located within the aperture, so that the via-holes are isolated from the first ground plane.

The distance between the first and second via-holes may be longer than the distance between the first and second microstrip lines.

Preferably, the distance between the first and second via-holes is selected such that a return loss is desirable.

Alternatively, the distance between the first and second via-holes may be substantially equal to the distance between the first and second microstrip lines.

In a preferred embodiment, the diameter of the first and second signal via-holes is less than 0.1 mm.

Preferably, the diameter of the first and second signal via-holes is selected such that a return loss is desirable.

In accordance with another aspect of the present invention, there is provided a vertical transition device for differential stripline paths, comprises first differential triplate paths and second differential triplate paths. The first differential triplate paths include a first dielectric layer, a second dielectric layer, a first ground plane disposed on a surface of the first dielectric layer, a second ground plane disposed on a surface of the second dielectric layer, and first and second triplate lines interposed between the first and second dielectric layers, the first and second triplate lines and the first and second dielectric layers causing an electric field coupling for propagating differential signals. The second differential triplate paths include a third dielectric layer, a fourth dielectric layer, the second ground plane interposed between the second and third dielectric layers, a third ground plane disposed on a surface of the fourth dielectric layer, third and fourth triplate lines disposed between the third and fourth dielectric layers, the third and fourth triplate lines and the second and third dielectric layers causing an electric field coupling for propagating the differential signals. The vertical transition device further comprises a first via-hole for connecting an end of the first triplate line with an end of the third triplate line, a second via-hole for connecting an end of the second triplate line with an end of the fourth triplate line, and an aperture formed in the second ground plane, the first and second via-holes are located within the aperture, so that the via-holes are isolated from the second ground plane.

Preferably, the distance between the first and second via-holes is substantially equal to the distance between the first and second triplate lines or to the distance between the third and fourth triplate lines.

In accordance with another aspect of the present invention, there is provided an optical module comprising an optical semiconductor device and any one of the above-described vertical transition devices for propagating differential signals to or from the optical semiconductor device inside the optical module.

BRIEF DESCRIPTION OF THE DRAWINGS

With reference to the accompanying drawings, various embodiments of the present invention will be described hereinafter. In the drawings.

DETAILED DESCRIPTION OF PREFERRED EMBODIMENTS

First Embodiment

Figure 1:
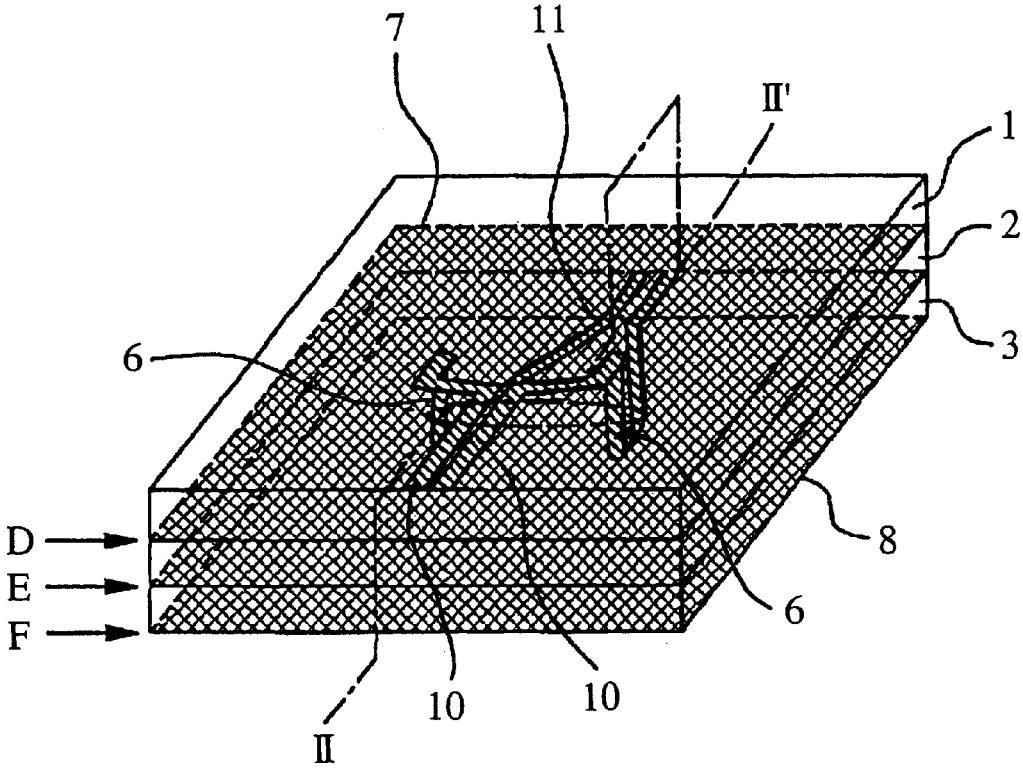
FIG. 1 is a see-through perspective view showing a vertical transition device for differential stripline paths according to a first embodiment of the present invention.
Figure 2:
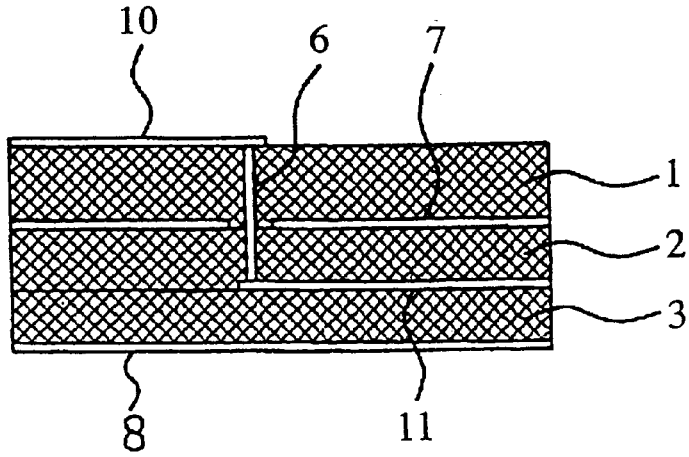
FIG. 2 is a vertical cross sectional view taken along line II–II' in FIG. 1.
Figure 3A:
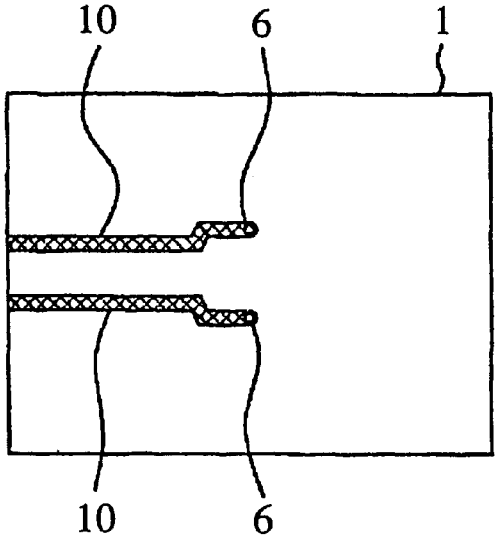
FIG. 3A is a top view of the vertical transition device of FIG. 1.
Figure 3B:
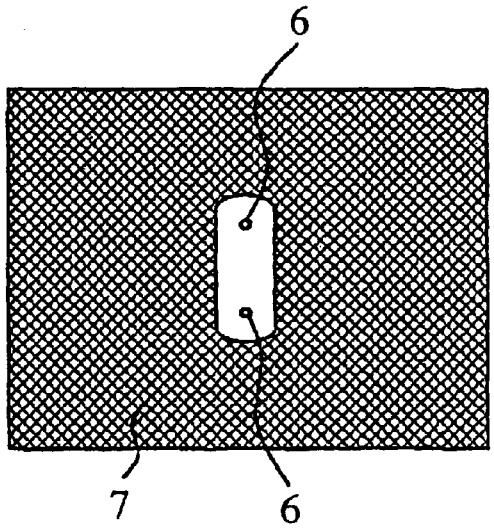
FIG. 3B is a horizontal sectional diagram of the vertical transition device taken along plane D in FIG. 1.
Figure 3C:
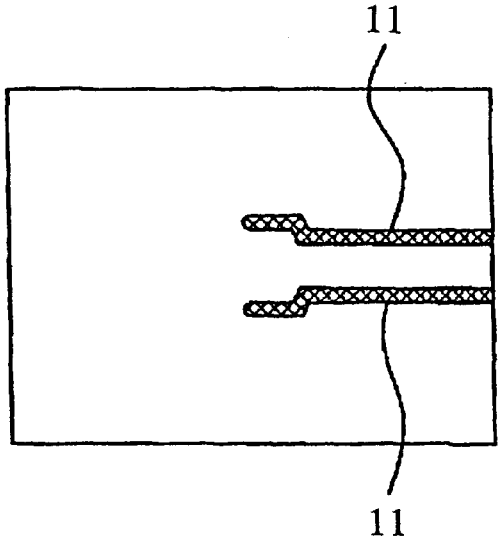
FIG. 3C is a horizontal sectional diagram of the vertical transition device taken along plane E in FIG. 1.
Figure 3D:
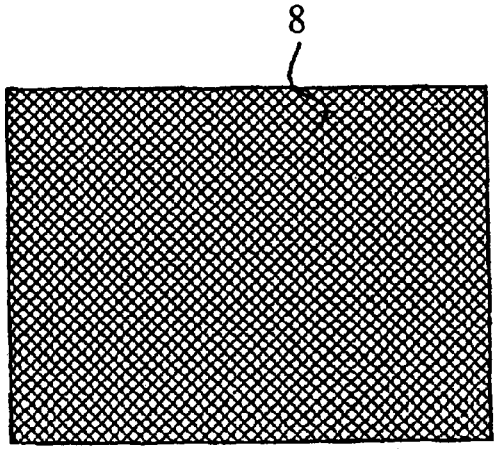
FIG. 3D is a horizontal sectional diagram of the vertical transition device taken along plane F in FIG. 1.
Figure 4:
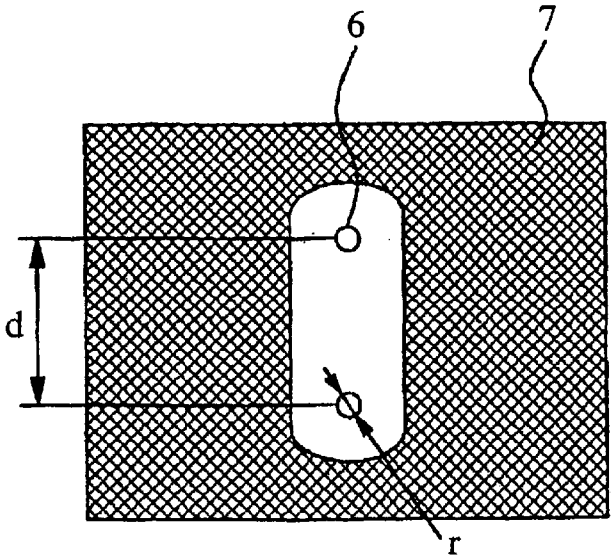
FIG. 4 is an enlarged view of signal via-holes and their vicinities shown in FIG. 3B.
Figure 5:
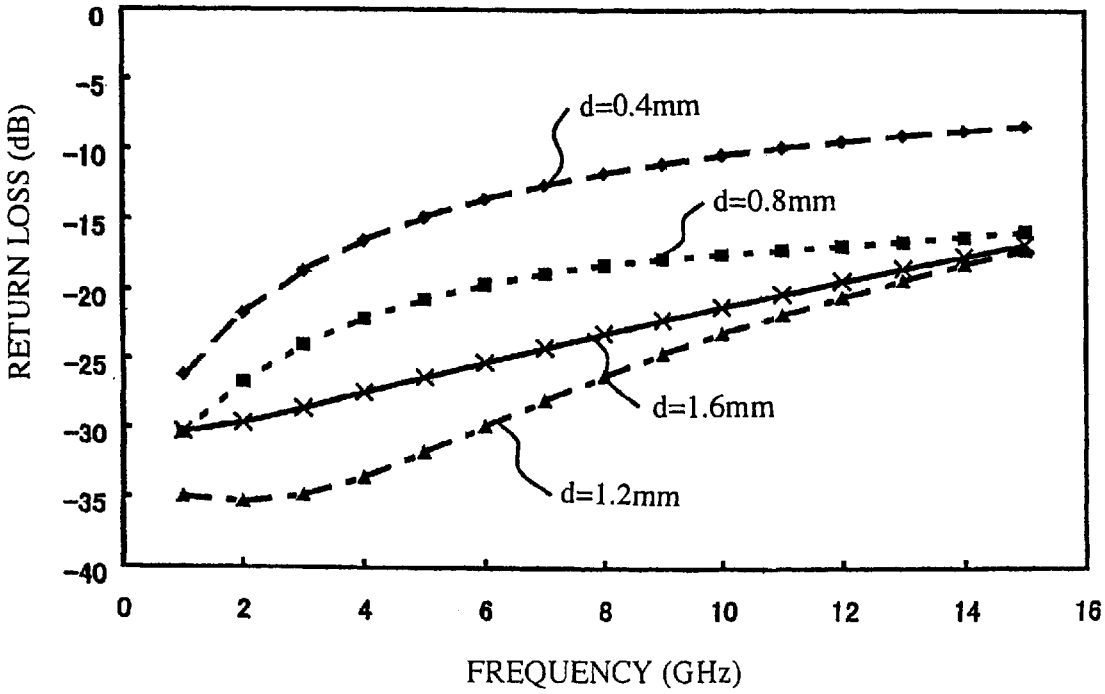
FIG. 5 is a graph showing results of simulations for calculating characteristics of the vertical transition device according to the first embodiment of the present invention.

FIG. 1 is a see-through perspective view showing a vertical transition device for differential stripline paths according to a first embodiment of the present invention. FIG. 2 is a vertical cross sectional view taken along line II–II' in FIG. 1. FIG. 3A is a top view of the vertical transition device of FIG. 1. FIG. 3B is a horizontal sectional diagram of the vertical transition device taken along plane D in FIG. 1. FIG. 3C is a horizontal sectional diagram of the vertical transition device taken along plane E in FIG. 1. FIG. 3D is a horizontal sectional diagram of the vertical transition device taken along plane F in FIG. 1. FIG. 4 is an enlarged view of signal via-holes 6 and their vicinities shown in FIG. 3B. FIG. 5 is a graph showing results of simulations for calculating characteristics of the vertical transition device according to the first embodiment of the present invention. This simulation was carried out in accordance with the finite element method.

As shown in the drawings, the vertical transition device comprises a sandwich of three parallel dielectric layers 1, 2, and 3, a pair of differential microstrip lines 10, a pair of differential triplate lines 11, a pair of signal via-holes 6, and two ground planes 7 and 8. The uppermost dielectric layer 1 and the middle dielectric layer 2 are substantially entirely separated by the ground plane 7. The other ground plane 8 is fixedly secured to the bottom surface of the lowermost dielectric layer 3. The differential microstrip lines 10 are formed on the upper surface of the uppermost dielectric layer 1 while the differential triplate lines 11 are formed between the middle and lowermost dielectric layers 2 and 3.

Differential microstrip paths are formed of the differential microstrip lines 10, the uppermost dielectric layer 1, and the ground plane 7 beneath the dielectric layer 1. On the other hand, differential triplate paths are formed of the middle and lowermost dielectric layers 2 and 3, the differential triplate lines 11 therebetween, and the ground planes 7 and 8 on the dielectric layers 2 and 3.

The differential microstrip lines 10 are connected with the differential triplate lines 11 via the signal via-holes 6, respectively. Each signal via-hole 6 penetrates thoroughly the uppermost and middle dielectric layers 1 and 2. As shown in FIG. 3B, the ground plane 7 is provided with an aperture within which the signal via-holes 6 are located, so that the signal via-holes 6 are isolated from the ground plane 7.

Next, a specific design of the vertical transition device will be described.

Figure 12:
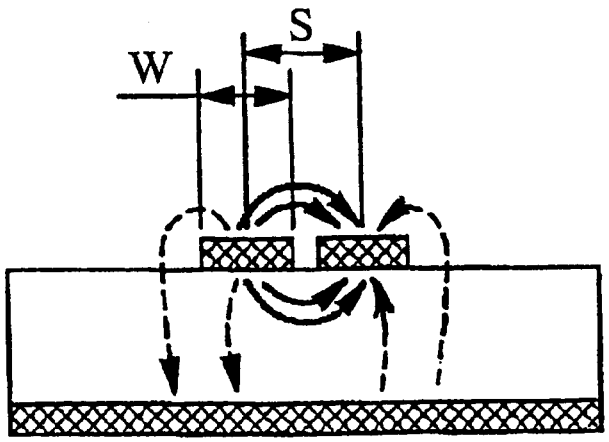
FIG. 12 is a conceptual diagram showing a cross section of differential microstrip paths.
Figure 11A:
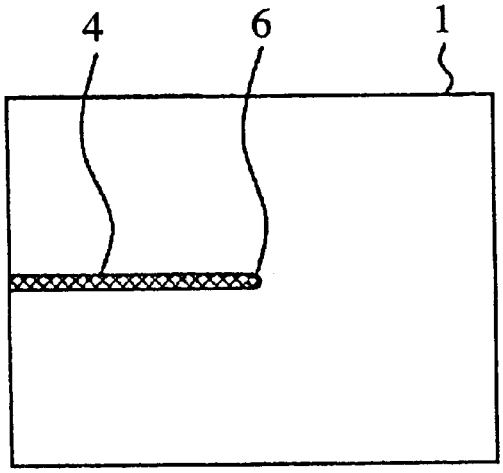
FIG.11A (PRIOR ART)
FIG. 11A is a top view of the vertical transition device.
Figure 11B:
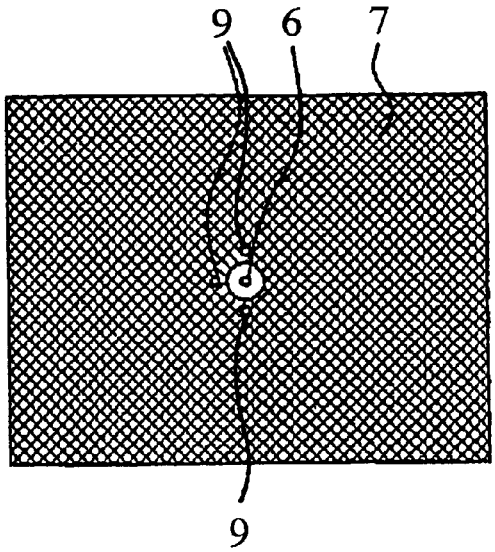
FIG.11B (PRIOR ART)
FIG. 11B is a horizontal sectional diagram of the vertical transition device taken along plane A in FIG. 9.
Figure 11C:
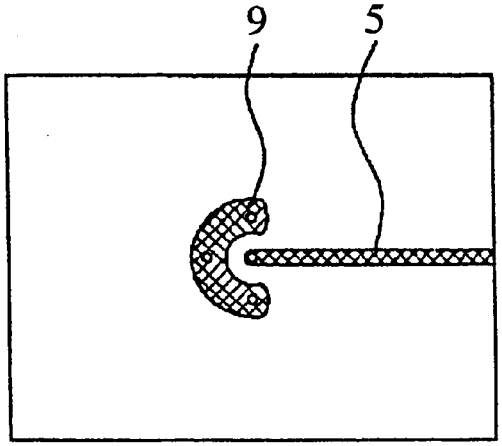
FIG.11C (PRIOR ART)
FIG. 11C is a horizontal sectional diagram of the vertical transition device taken along plane B in FIG. 9.
Figure 11D:
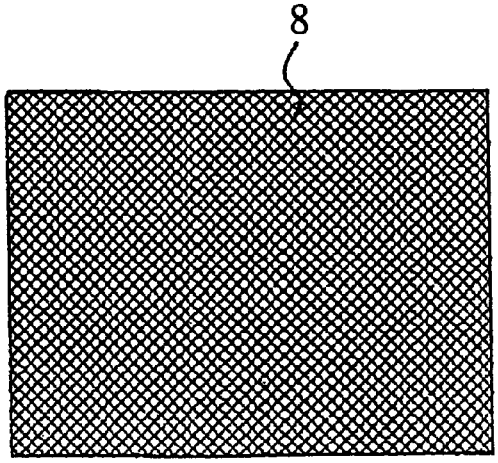
FIG.11D (PRIOR ART)
FIG. 11D is a horizontal sectional diagram of the vertical transition device taken along plane C in FIG. 9.

With reference to the differential microstrip paths including the conductor lines 10, it is possible to adjust the characteristic impedance of the differential microstrip paths by suitably selecting the distance S between the conductor lines 10 and the width W thereof (see FIG. 12). Similarly, with reference to the differential triplate paths including the conductor lines 11, it is possible to adjust the characteristic impedance of the differential triplate paths by suitably selecting the distance S between the conductor lines 11 and the width W thereof. The narrower the distance S is, the better, as described above.

On the other hand, let us contemplate the characteristic impedance of the signal via-holes 6. Each signal via-hole 6 can be considered as parallel lines. The characteristic impedance Zo of the parallel lines can be expressed by formula (1).

$$Zo = \frac{276}{\sqrt{\epsilon_r}} \log_{10} 2\frac{d}{r} \tag{1}$$

where $\in_r$ is the effective dielectric constant of the dielectric layers, d is the distance between the signal via-holes 6, r is the diameter of the signal via-holes 6. The electric potential at the center between the parallel lines can be expediently considered to be zero because of the intensity distribution in the electric fields around the parallel lines generated by differential signals. Therefore, the impedance of the via-hole 6 is Zo/2 with respect to the center of the parallel lines.

Now, let us assume that the characteristic impedance of each of the differential microstrip lines 10 and the differential triplate lines 11 is 50 Ω. For example, this can be achieved by the following parameters.

The thickness of each of the dielectric layers 1, 2, and 3 is equal to 0.2 mm while $\in_r$ equals 8.6. With regard to the differential microstrip lines 10, the distance S equals 0.4 mm while width W equals 0.19 mm. Concerning the differential triplate lines 11, the distance S equals 0.4 mm and the width W equals 0.08 mm.

On the other hand, when the diameter r of the signal via-holes 6 is 0.2 mm and the distance d between the via-holes 6 is equal to the distance S (0.4 mm), the characteristic impedance Zo/2 of the parallel via-hole 6 is calculated at 28 Ω in accordance with formula (1). However, for matching the characteristic impedance Zo/2 with the characteristic impedance of the differential microstrip lines 10 and differential triplate lines 11, it should be 50 Ω.

As will be understood from formula (1), in order to satisfy the requirement that Zo/2=50 Ω, it is necessary to lessen the diameter r of the signal via-holes 6 or to enlarge the distance d between the holes 6. However, it is sometimes impossible to lessen the diameter r under manufacturing conditions for forming the signal via-holes 6. When the diameter r must be thus 0.2 mm, the distance d is calculated at 1.2 mm by formula (1) to satisfy the requirement that Zo/2=50 Ω. Therefore, in such a case, the distance d should be 1.2 mm for realizing impedance matching.

However, the calculated distance d (1.2 mm) between the signal via-holes 6 is different from the distance S (0.4 mm) between the microstrip lines 10 and 10 (and between the triplate lines 11 and 11). Therefore, as shown in FIGS. 1, 3A, and 3C, it is preferable that the distance between the microstrip lines 10 and 10 is incrementally enlarged in the vicinity of the signal via-holes 6. The same is true with the distance between the triplate lines 11 and 11. Although the line distance is enlarged in this manner, when the width W of lines is appropriately enlarged in accordance with the increment of the line distance S, the characteristic impedance can be maintained to be 50 Ω uniformly. This can be accomplished while maintaining field coupling of the lines, thereby preventing the propagation of differential signals from being affected.

Referring now to the graph in FIG. 5, the return loss on the ordinate can be considered as a measure of the matching degree of the characteristic impedance of the signal via-holes 6 in relation to that of the differential microstrip lines 10 and the differential triplate lines 11. In FIG. 5, the lower the curves are, the better the matching status is. It can be recognized from FIG. 5 that when d is equal to 1.2 mm (and r is 0.2 mm), the return loss is the lowest causing the best impedance matching at any frequencies.

As described above, in accordance with the first embodiment of the present invention, it is possible to manufacture a vertical transition device incorporating a pair of adjoining differential paths while the impedance of the signal via-holes 6 can be matched with lines 10 and lines 11. In addition, the matching via-holes 9 for connecting the ground plane 7 with ground plane 8 can be excluded in contrast to prior art. Therefore, the size of the vertical transition device may be lessened or minimized.

Furthermore, although the diameter of the signal via-holes 6 of the differential stripline paths cannot be lessened, the characteristic impedance of the signal via-holes 6 can be selected to an optimum by suitably adjusting the distance between the signal via-holes 6 without affecting the propagation of differential signals.

In the first embodiment, although the impedance matching is accomplished by selecting the distance d between the signal via-holes 6, it is not intended to limit the present invention to the disclosure. Alternatively, the impedance matching can be accomplished by changing the diameter r of the signal via-holes 6 insofar as no problem occurs in the forming process of the signal via-holes 6. Although it is possible to form a via-hole with a diameter less than 0.1 mm according to the latest technology. various difficulties are involved in manufacturing.

Second Embodiment

Figure 6:
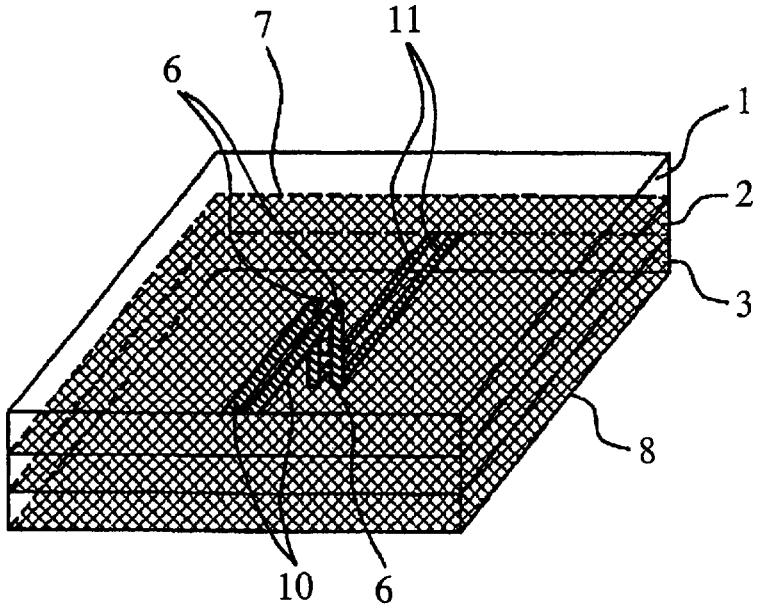
FIG. 6 is a see-through perspective view showing a vertical transition device for differential stripline paths according to a second embodiment of the present invention.

FIG. 6 is a see-through perspective view showing a vertical transition device for differential stripline paths according to a second embodiment of the present invention. In FIG. 6, the same reference signs are used for identifying the elements that have been described in conjunction with the first embodiment for simplifying description of such elements.

The differential microstrip lines 10 formed on the uppermost dielectric layer 1 are connected with the differential triplate lines 11 formed between the middle and lowermost dielectric layers 2 and 3 via the signal via-holes 6, respectively. Each signal via-hole 6 penetrates thoroughly the uppermost and middle dielectric layers 1 and 2. In contrast to the first embodiment, each of the conductor lines 10 and 11 is straight. Each set of line constituted of a conductor line 10, a via-hole 6, and a conductor line 11 is aligned in a vertical cross section. These sets are arranged in parallel. One vertical cross section of FIG. 6 is the same as that shown in FIG. 2. The signal via-holes 6 and their vicinities are also the same as those shown in FIG. 4.

Next, a specific design of the vertical transition device will be described.

The theory about the characteristic impedance of the signal via-holes 6 is the same as that described above in conjunction with the first embodiment, and therefore formula 1 can be also applied to the second embodiment similarly.

Now, let us assume the same condition described above in conjunction with the first embodiment. That is, the characteristic impedance of each of the differential microstrip lines 10 and the differential triplate lines 11 is 50 Ω. However, in the second embodiment, the distance d between the signal via-holes 6 should be equal to the distance S between the conductor lines 10 and 10 (and between the conductor lines 11 and 11).

Assume that the distance d is 0.4 mm. When the diameter r of the signal via-holes 6 is 0.2 mm, the characteristic impedance Zo/2 of the twin signal via-hole 6 is calculated at 28 Ω in accordance with formula (1). However, for matching the characteristic impedance Zo/2 with the characteristic impedance of the differential microstrip lines 10 and differential triplate lines 11, it should be 50 Ω. Then, it is necessary to lessen the diameter r of the signal via-holes 6 as will be understood from formula (1). The diameter r satisfying formula (1) is calculated at 0.07 mm when the distance d is 0.4 mm.

Therefore, if it is possible to form the signal via-holes 6 having the diameter as discussed above, the signal via-holes 6 can be aligned with the conductor lines 10 and 11 and the distance can be uniform throughout the lines 10 and 11 and the via holes 6. This can contribute to downsize the vertical transition device in which impedance matching is accomplished. By virtue of the latest technology, the possible smallest diameter of via-holes is about 0.08 mm.

Third Embodiment

Figure 7:
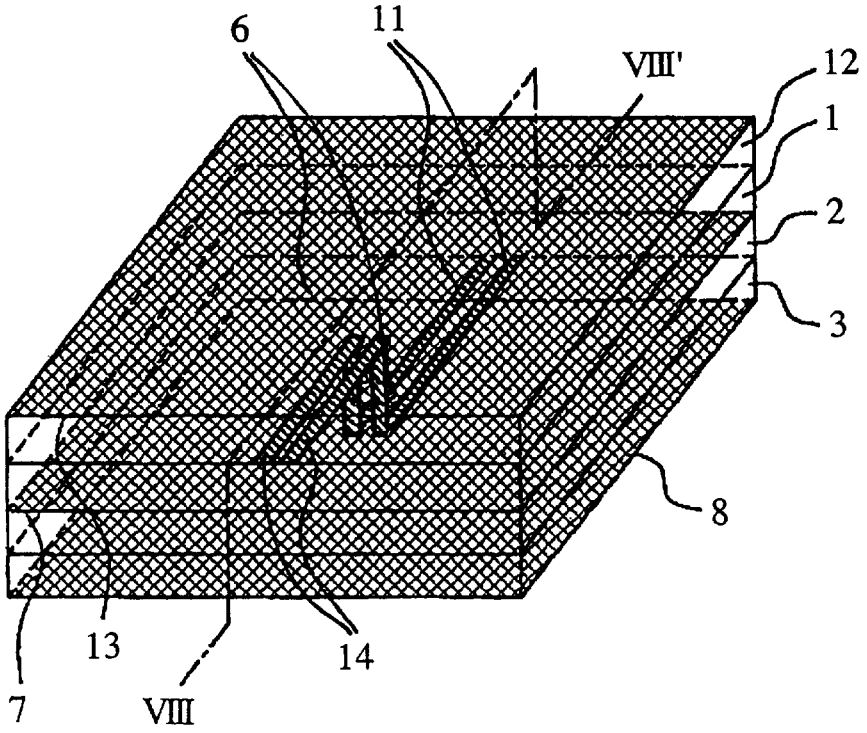
FIG. 7 is a see-through perspective view showing a vertical transition device for differential stripline paths according to a third embodiment of the present invention.
Figure 8:
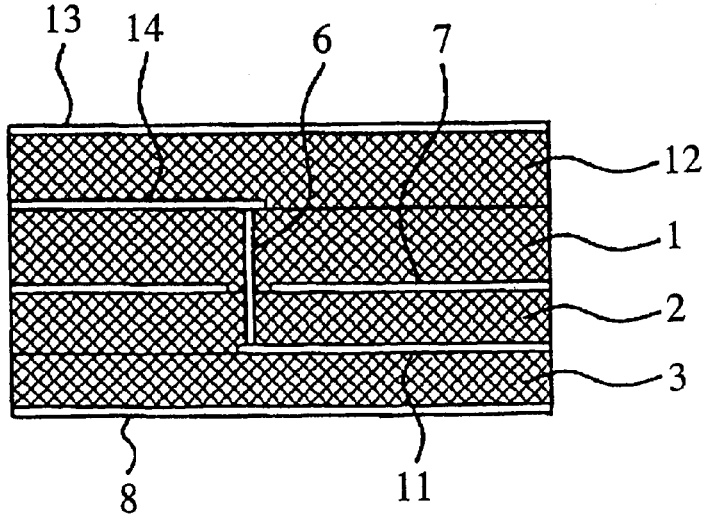
FIG. 8 is a cross sectional view taken along line VII-I–VIII' in FIG. 7.
Figure 9:
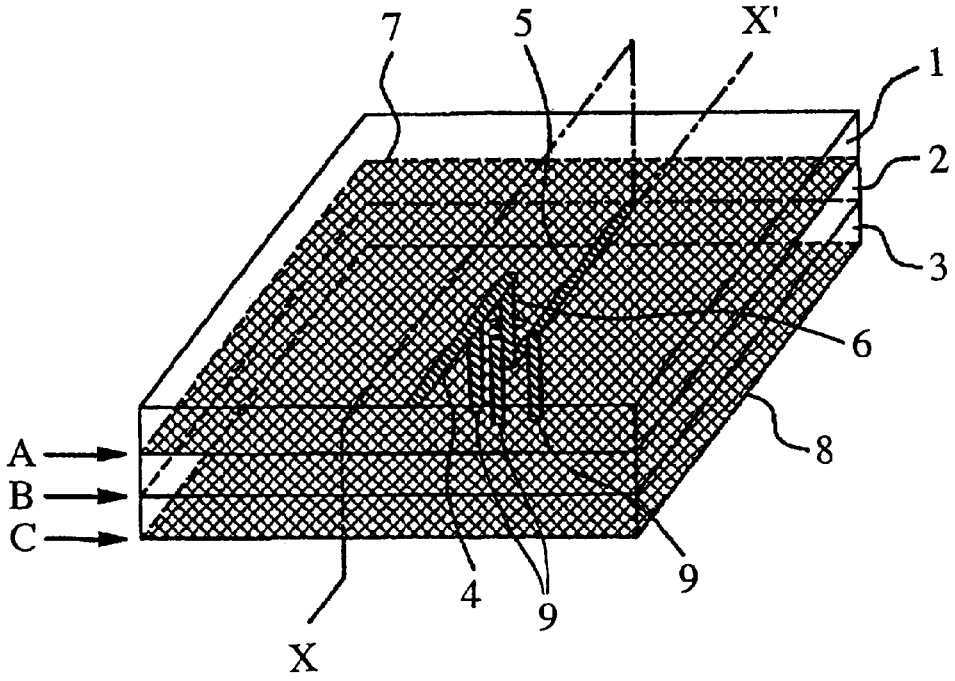
FIG.9 (PRIOR ART)
FIG. 9 is a see-through perspective view showing a conventional vertical transition device for a stripline path.
Figure 10:
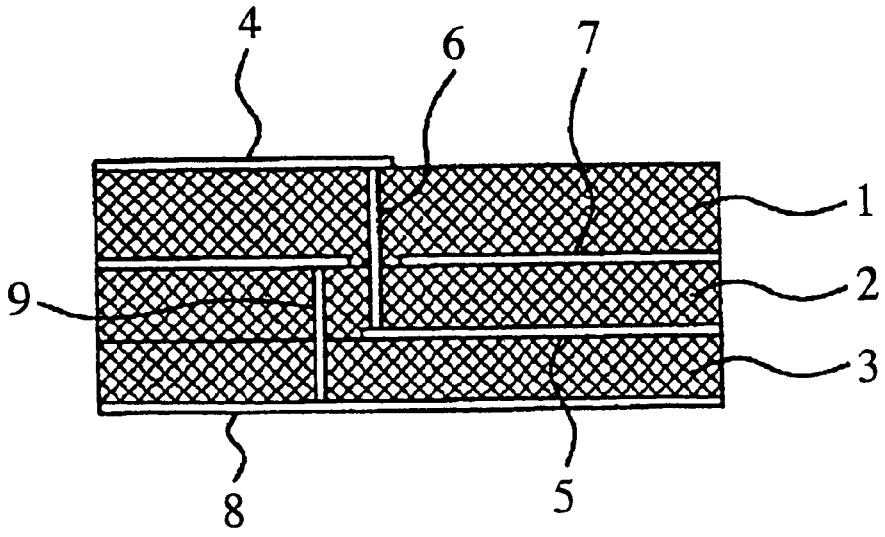
FIG.10 (PRIOR ART)
FIG. 10 is a vertical cross sectional view taken along line X–X' in FIG. 9.

FIG. 7 is a see-through perspective view showing a vertical transition device for differential stripline paths according to a third embodiment of the present invention. FIG. 8 is a cross sectional view taken along line VIII–VIII' in FIG. 7.

As shown in the drawings, the vertical transition device comprises a sandwich of four parallel dielectric layers 12, 1, 2, and 3, a pair of differential triplate lines 14, a pair of differential triplate lines 11, a pair of signal via-holes 6, and three ground planes 13, 7, and 8. The second dielectric layer 1 and the third dielectric layer 2 are substantially entirely separated by the ground plane 7. The other ground plane 8 is fixedly secured to the bottom surface of the lowermost dielectric layer 3. The differential triplate lines 14 are formed between the uppermost dielectric layer 12 and the second dielectric layer 1 while the differential triplate lines 11 are formed between the third and lowermost dielectric layers 2 and 3.

A pair of differential triplate paths are formed of the uppermost and second dielectric layer 12 and 1, the differential triplate lines 14 therebetween, and the ground planes 13 and 7 on the dielectric layers 12 and 1. Another pair of differential triplate paths are formed of the third and lowermost dielectric layers 2 and 3, the differential triplate lines 11 therebetween, and the ground planes 7 and 8 on the dielectric layers 2 and 3.

The differential triplate lines 14 are connected with the differential triplate lines 11 via the signal via-holes 6, respectively. Each signal via-hole 6 penetrates thoroughly the second and third dielectric layers 1 and 2. As shown in FIG. 8, the ground plane 7 is provided with an aperture within which the signal via-holes 6 are located, so that the signal via-holes 6 are isolated from the ground plane 7.

As similar to the second embodiment, each of the strip lines 10 and 11 is straight. Each set of line constituted of a strip line 10, a via-hole 6, and a strip line 11 is aligned in a vertical cross section.

Next, a specific design of the vertical transition device will be described.

The differential triplate lines 11 and 14 may be manufactured to have a desirable characteristic impedance by the theory that has been described in conjunction with the first embodiment. In addition, the theory about the characteristic impedance of the signal via-holes 6 is the same as that described above in conjunction with the first embodiment, and therefore formula 1 can be also applied to the third embodiment similarly.

Now, let us assume the same condition described above in conjunction with the first embodiment. That is, the characteristic impedance of each of the differential triplate lines 14 and the differential triplate lines 11 is 50 Ω. However, in the third embodiment, the distance d between the signal via-holes 6 should be equal to the distance S between the triplate lines 14 and 14 (and between the triplate lines 11 and 11).

Assume that the distance d is 0.4 mm. When the diameter r of the signal via-holes 6 is 0.2 mm, the characteristic impedance Zo/2 of the twin signal via-hole 6 is calculated at 28 Ω in accordance with formula (1). However, for matching the characteristic impedance Zo/2 with the characteristic impedance of the differential triplate lines 14 and differential triplate lines 11, it should be 50 Ω. Then, it is necessary to lessen the diameter r of the signal via-holes 6 or to enlarge the distance d between the signal via-holes 6 as will be understood from formula (1). The diameter rand the distance d can be equal to those determined in conjunction with the first and second embodiments. According to the first embodiment, the distance d is 1.2 mm and the diameter r is 0.2 mm. According to the second embodiment, the distance d is 0.4 mm and the diameter r is 0.07 mm.

As described above, in accordance with the third embodiment of the present invention, it is possible to manufacture a vertical transition device that can connect adjoining differential triplate paths on a horizontal plane to other differential triplate paths on another horizontal plane for propagating differential signals.

Fourth Embodiment

Figure 13:
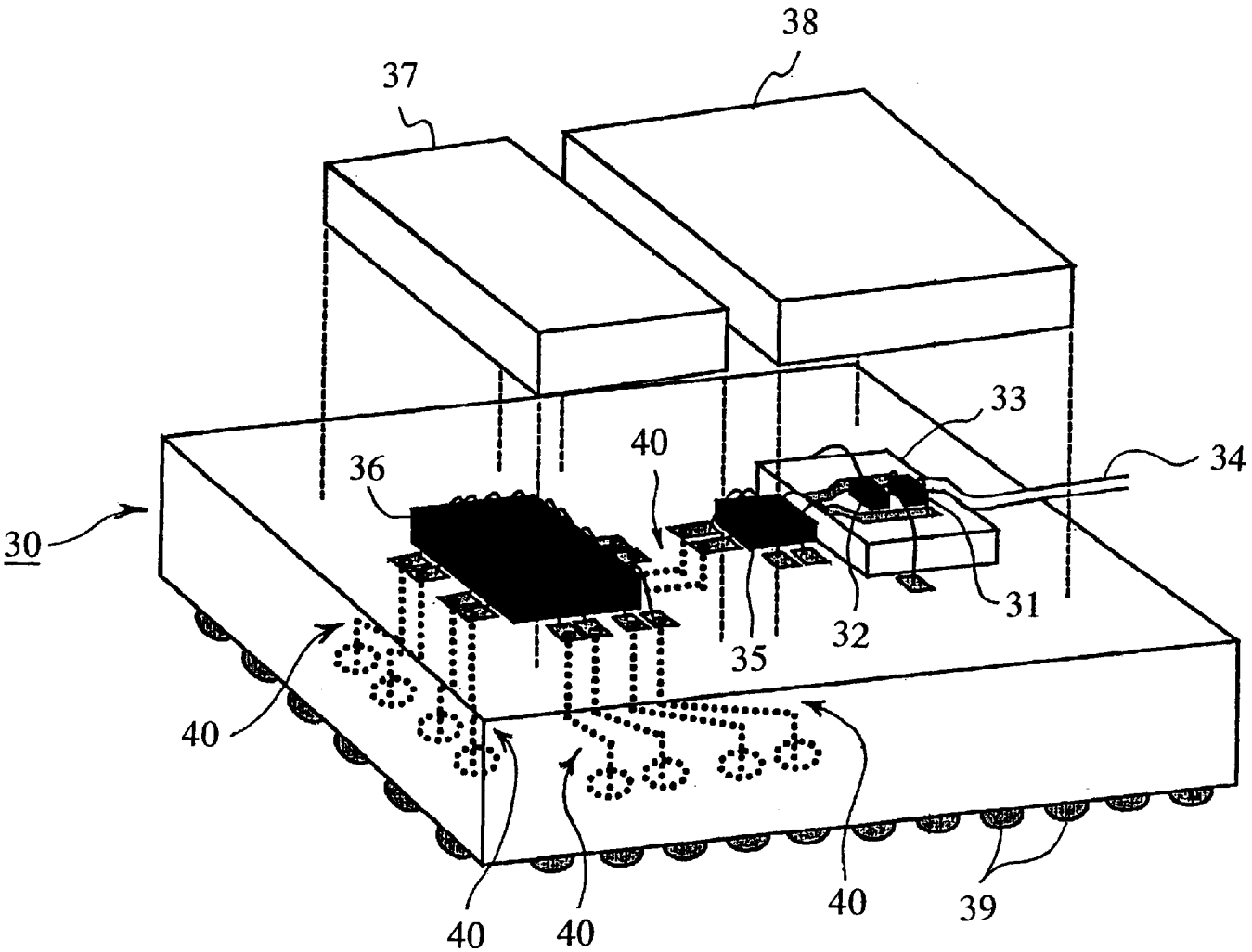
FIG. 13 is an exploded simplified perspective view showing an optical module incorporating the vertical transition devices according to any one of the first through third embodiments.

Referring now to FIG. 13, an optical module to which any one of preceding embodiments is applied will be described. The optical module in FIG. 13 includes a multilayered substrate 30 incorporating the multilayered architecture according to any one of preceding embodiments. In the illustrated embodiment, the multilayered substrate 30 is of a BGA (ball grid array) type package structure having balls 39 at the bottom thereof. A laser diode (E/O converting element) 31 and a photo diode 32 are mounted on an optical bench 33 attached on the top surface of the multilayered substrate 30. An optical fiber 34 is attached to the optical bench 33 for transmitting beams generated from the laser diode 31. An LD driver IC 35 is electrically connected with the laser diode 31 for driving it. The photodiode 32 receives beams generated from the laser diode 31 and serves for controlling the output of the laser diode 31.

The LD driver IC 35 is also electrically connected with a MUX (multiplexer) IC 36. The MUX IC 36 has a pair of electrodes for transmitting signals to the LD driver IC 35, and four pairs of electrodes that are connected with balls 39 on the bottom of the multilayered substrate 30. Therefore, the optical module of the embodiment can be used as an optical transmitter. The MUX IC 36 and its vicinities are protected by a cover 37 attached to the top surface of the multilayered substrate 30. The optical bench 33, LD driver IC 35, and their vicinities are protected by another cover 38 attached to the top surface of the multilayered substrate 30.

As briefly illustrated in FIG. 13, the multilayered substrate 30 incorporates five vertical transition devices 40 each of which is identical to the device according to any one of the preceding embodiments. One of the devices 40 is applied to paths between the output electrodes of the MUX IC 36 and the LD driver IC 35 for propagating signals therebetween. The other devices 40 are applied to paths between input electrodes of the MUX IC 36 and the balls 39 for propagating signals therebetween.

By virtue of the vertical transition devices 40 for differential stripline paths incorporated in this single unit of the optical module, it is possible to manufacture the optical module with an improved packing density while the module can output radio frequency signals at a few to tens of gigabits per second. In the embodiments, the vertical transition devices 40 are applied to an optical transmitting module. However, the vertical transition devices 40 may be also applied to an optical receiving module and an optical transmitting/receiving module.

While the present invention has been particularly shown and described with references to preferred embodiments thereof, it will be understood by those skilled in the art that various changes in form and details may be made therein without departing from the spirit and scope of the invention as defined by the claims. Such variations, alterations, and modifications are intended to be as equivalents encompassed in the scope of the claims.

What is claimed is:

1. A vertical transition device for differential stripline paths, comprising:

differential microstrip paths and differential triplate paths, the differential microstrip paths including a first dielectric layer;

a second dielectric layer;

a first ground plane interposed between the first and second dielectric layers; and first and second microstrip lines disposed on a surface of the first dielectric layer opposing to the first ground plane, the microstrip lines and the first dielectric layer causing an electric field coupling for propagating differential signals, the differential triplate paths including a third dielectric layer;

a second ground plane disposed on a surface of the third dielectric layer; and first and second triplate lines disposed between the second and third dielectric layers, the triplate lines and the first and second dielectric layers causing an electric field coupling for propagating the differential signals, wherein the vertical transition device further comprising:

a first via-hole for connecting an end of the first microstrip line with an end of the first triplate line;

a second via-hole for connecting an end of the second microstrip line with an end of the second triplate line; and an aperture formed in the first ground plane, the first and second via-holes are located within the aperture, so that the via-holes are isolated from the first ground plane.

2. A vertical transition device for differential stripline paths according to claim 1, wherein a distance between the first and second via-holes is longer than a distance between the first and second microstrip lines.

3. A vertical transition device for differential stripline paths according to claim 2, wherein the distance between the first and second via-holes is selected such that a return loss is desirable.

4. A vertical transition device for differential stripline paths according to claim 1, wherein a distance between the first and second via-holes is substantially equal to a distance between the first and second microstrip lines.

5. A vertical transition device for differential stripline paths according to claim 4, wherein a diameter of the first and second signal via-holes is less than 0.1 mm.

6. A vertical transition device for differential stripline paths according to claim 4, wherein a diameter of the first and second signal via-holes is selected such that a return loss is desirable.

7. A vertical transition device for differential stripline paths, comprising:

first differential triplate paths and second differential triplate paths, the first differential triplate paths including a first dielectric layer;

a second dielectric layer;

a first ground plane disposed on a surface of the first dielectric layer;

a second ground plane disposed on a surface of the second dielectric layer; and first and second triplate lines interposed between the first and second dielectric layers, the first and second triplate lines and the first and second dielectric layers causing an electric field coupling for propagating differential signals, the second differential triplate paths including a third dielectric layer;

a fourth dielectric layer;

the second ground plane interposed between the second and third dielectric layers;

a third ground plane disposed on a surface of the fourth dielectric layer;

third and fourth triplate lines disposed between the third and fourth dielectric layers, the third and fourth triplate lines and the second and third dielectric layers causing an electric field coupling for propagating the differential signals, wherein the vertical transition device further comprising:

a first via-hole for connecting an end of the first triplate line with an end of the third triplate line;

a second via-hole for connecting an end of the second triplate line with an end of the fourth triplate line; and an aperture formed in the second ground plane, the first and second via-holes are located within the aperture, so that the via-holes are isolated from the second ground plane.

8. A vertical transition device for differential stripline paths according to claim 7, wherein a distance between the first and second via-holes is substantially equal to a distance between the first and second triplate lines or to a distance between the third and fourth triplate lines.

9. An optical module comprising an optical semiconductor device and a vertical transition device according to claim 1 for propagating differential signals to or from the optical semiconductor device inside the optical module.

10. An optical module comprising an optical semiconductor device and a vertical transition device according to claim 7 for propagating differential signals to or from the optical semiconductor device inside the optical module.

* * * * *